United States Patent [19]

Likins, Jr. et al.

[11] Patent Number: 4,583,497

[45] Date of Patent: Apr. 22, 1986

[54] BOILER CONTROL

[75] Inventors: Merle R. Likins, Jr.; Ronald J. LaSpisa, both of Bartlesville, Okla.

[73] Assignee: Phillips Petroleum Company, Bartlesville, Okla.

[21] Appl. No.: 589,445

[22] Filed: Mar. 14, 1984

[51] Int. Cl.[4] ..... F22B 9/00

[52] U.S. Cl. ..... 122/448 B; 60/664

[58] Field of Search ..... 122/448 B, 448 R; 236/14; 60/664; 237/67, 8 R

[56] References Cited

U.S. PATENT DOCUMENTS

| | | | |
|---|---|---|---|
| 3,837,167 | 9/1974 | Durrant et al. | 122/448 B |
| 3,862,403 | 1/1975 | Kurihara | 122/448 R |
| 3,908,897 | 9/1975 | van Holtz et al. | 236/14 |
| 4,064,699 | 12/1977 | Martz | 60/664 |
| 4,418,541 | 12/1983 | Russel | 122/448 B |

FOREIGN PATENT DOCUMENTS

| | | | |
|---|---|---|---|
| 41961 | 5/1967 | Japan | 122/448 B |

*Primary Examiner*—Henry Bennett

*Attorney, Agent, or Firm*—French and Doescher

[57] ABSTRACT

Boiler optimization is included in on-line control of parallel boilers by multiplying the total heat per unit time which must be supplied to all parallel boilers by the percentage of the total heat which should be supplied to each boiler in order to substantially maximize energy efficiency. The result of such multiplication is the heat per unit time which should be supplied to each boiler. The fuel and air supplied to each boiler is controlled so as to supply the thus determined heat per unit time which not only results in maintenance of a desired header pressure but also results in substantially maximizing energy efficiency of the parallel boilers.

4 Claims, 2 Drawing Figures

BOILER CONTROL

Figure 1:
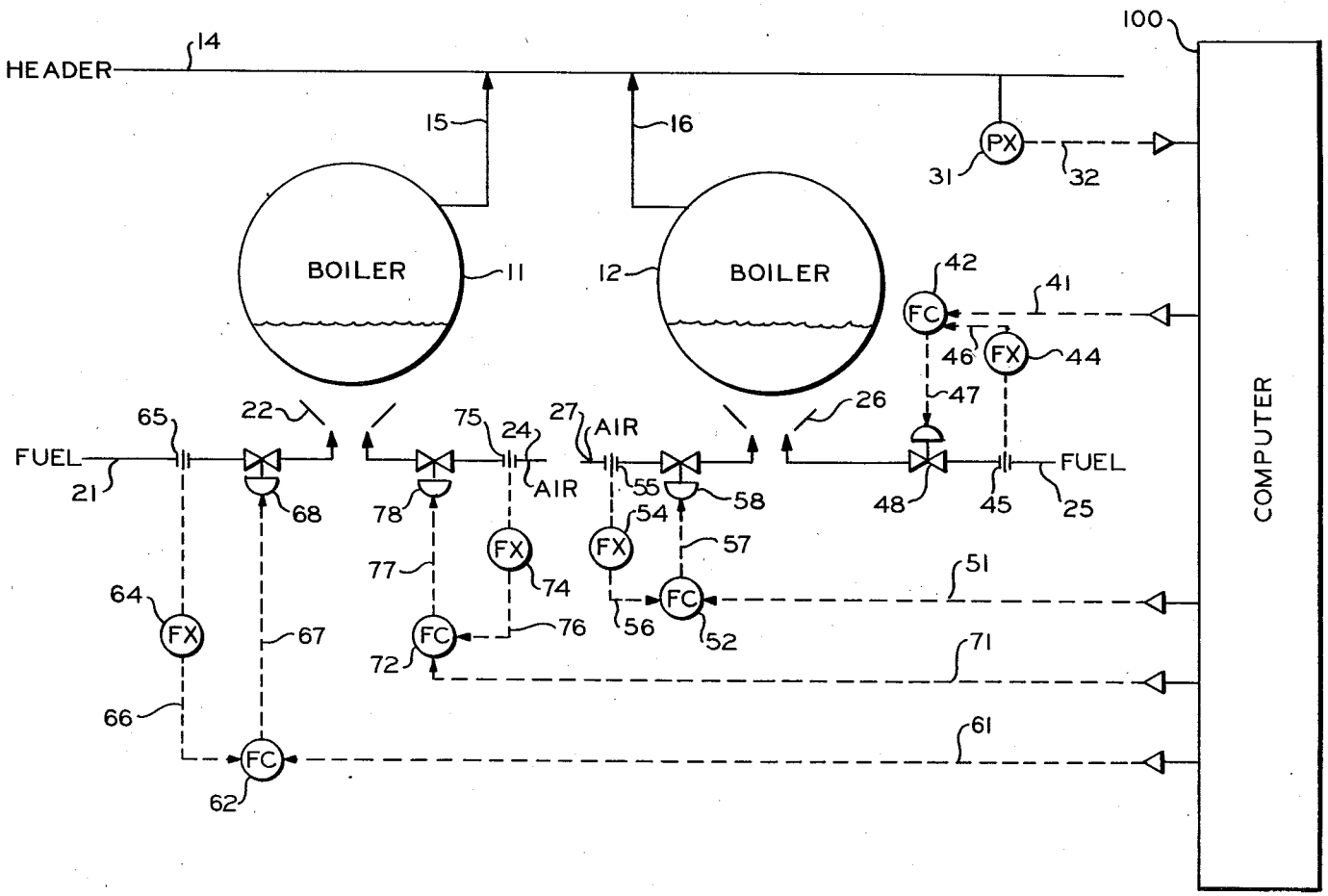

This invention relates to control of parallel boilers which supply steam to a common header. In one aspect this invention relates to method and apparatus for including optimization of parallel boilers in an on-line control system.

Boilers are often utilized to supply steam for a process. in many cases, parallel boilers are utilized to supply steam to a common header. The various steam users then draw steam from the common header.

Steam usage by a process will usually vary as a function of time. However, it is usually desirable to maintain a substantially constant header pressure even though the steam usage varies. This is generally accomplished by varying the firing rate for the parallel boilers so as to maintain a substantially constant header pressure even when steam usage varies.

Where parallel boilers are utilized, the steam header pressure may be maintained by varying the firing rate of all parallel boilers by the same amount. As an example, if two parallel boilers are employed, the boilers could be operated so as to always supply one-half of the steam flow required to maintain the desired header pressure.

It has been found that, because of differences in boiler construction and operating characteristics, operation of parallel boilers so as to supply equal portions of the required load results in less than optimum energy usage. At some firing rates it might be desirable to have a first boiler supply 60% of the steam and a second boiler supply 40% of the steam while at other firing rates it might be desirable to have the first boiler supply 45% of the steam and the second boiler supply 55% of the steam. The determination of how much steam should be supplied by each boiler (which may be expressed in terms of steam flow rate or heat per unit time or some other desired parameter) in order to maintain maximum energy efficiency is generally referred to as boiler optimization.

Several boiler optimization methods are known. Generally, various process measurements are utilized to calculate the amount of the load which should be supplied by each one of a series of parallel boilers to substantially maximize the energy efficiency of the parallel boilers. However, in the past, it has been difficult to include the results of such optimization methods in on-line control of a parallel boilers in such a manner that operator intervention is not required.

It is thus an object of this invention to provide method and apparatus for using optimization of parallel boilers in on-line control of a process where parallel boilers are utilized to supply steam to a common header.

In accordance with the present invention, method and apparatus is provided whereby the total heat per unit time which must be supplied to all parallel boilers is multiplied by the percentage of the total heat which should be supplied to each boiler in order to substantially maximize energy efficiency in order to determine the heat per unit time which should be supplied to each boiler. The fuel and air supplied to each boiler is controlled so as to supply the thus determined heat per unit time which not only results in maintenance of a desired header pressure but also results in substantially maximizing the energy efficiency of the parallel boilers.

Figure 2:
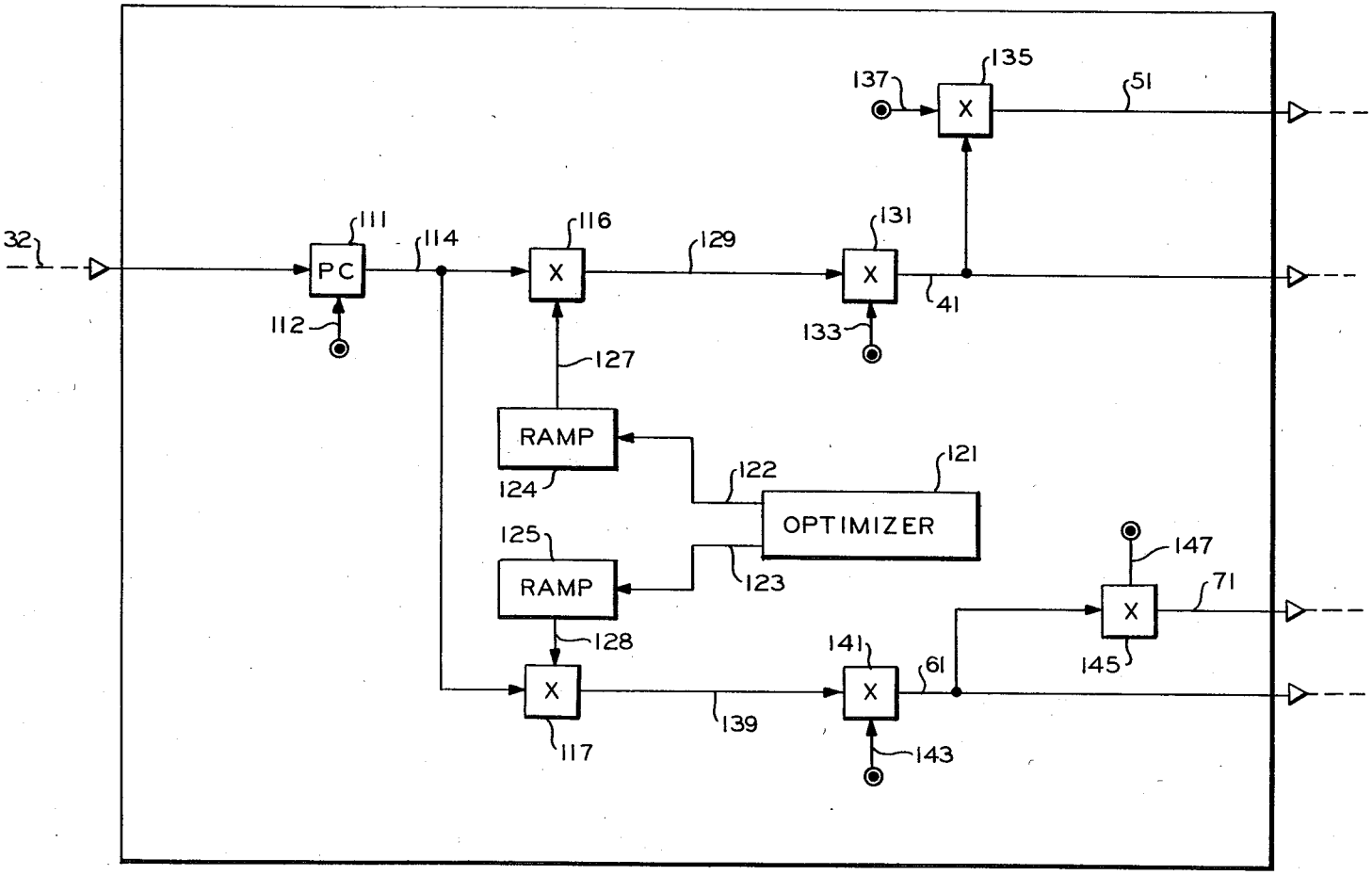

Other objects and advantages of the invention will be apparent from the foregoing brief description of the invention and the claims as well as the detailed description of the drawings which are briefly described as follows:

FIG. 1 is a diagrammatic illustration of two boilers supplying steam to a common header and the associated control system of the present invention; and FIG. 2 is a diagrammatic illustration of the computer logic utilized to generate the control signals illustrated in FIG. 1 based on the process measurements illustrated in FIG. 1.

The invention is illustrated and described in terms of two boilers. However, the invention is applicable to more than two parallel boilers and would generally be applied to more than two parallel boilers.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate are compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a boiler 11 and a boiler 12 are illustrated. Boiler 11 supplies steam to the common header 14 through conduit means 15. In like manner, boiler 12 supplies steam to the common header 14 through conduit means 16.

Fuel is supplied through conduit means 21 to the burner 22 associated with the boiler 11. Air is supplied to the burner 22 through conduit means 24. The combustion of the fuel flowing through conduit means 21 with the air flowing through conduit means 24 at the burner 22 supplies heat to the boiler 11.

In like manner, fuel is supplied through conduit means 25 to the burner 26 associated with the boiler 12. Air is supplied through conduit means 27 to the burner 26. Th combustion of the fuel flowing through conduit means 25 with the air flowing through conduit means 27 at the burner 26 supplies heat to the boiler 12.

Pressure transducer 31 in combination with a pressure sensing device, which is operably located in the header 14, provides an output signal 32 which is representative of the actual header pressure. Signal 32 is provided from the pressure transducer 31 as an input to computer 100.

Other process measurements would generally be required for the optimization which will be described hereinafter. However, since these process measurements may vary depending upon the optimization method chosen, these process measurements are not illustrated in FIG. 1 or described at this point.

In response to signal 32 and also in response to any process measurements required for optimization, computer 100 provides four output control signals. A brief description of each of these process control signals and the manner in which it is utilized for process control follows.

Signal 41 is representative of the flow rate of fuel through conduit means 25 required to supply sufficient heat to the boiler 12 to enable the boiler 12 to supply the steam required from boiler 12 to the common header 14. Signal 41 is supplied as the set point input to the flow controller 42.

Flow transducer 44 in combination with the flow sensor 45, which is operably located in conduit means 25, provides an output signal 46 which is representative of the actual flow rate of fuel through conduit means 25. Signal 46 is supplied as the process variable input to the flow controller 42.

In response to signals 41 and 46, flow controller 42 provides an output signal 47 which is responsive to the difference between signals 41 and 46. Signal 47 is scaled so as to be representative of the position of the control valve 48, which is operably located in conduit means 25, required to maintain the actual flow rate of fuel through conduit means 25 substantially equal to the desired flow rate represented by signal 41. Signal 47 is provided from the flow controller 42 as the control signal for control valve 48 and control valve 48 is manipulated in response thereto.

Signal 51 is representative of the flow rate of air through conduit means 27 required for complete combustion of the fuel flowing through conduit means 25. It is noted that, in some cases, it may be desired to supply excess air. The manner in which that may be accomplished will be described more fully hereinafter. Signal 51 is provided as the set point input to the flow controller 52.

Flow sensor 55 in combination with the flow transducer 54, which is operably located in conduit means 27, provides an output signal 56 which is representative of the actual flow rate of air through conduit means 27. Signal 56 is supplied from the flow transducer 54 as the process variable input to the flow controller 52.

In response to signals 51 and 56, the flow controller 52 provides an output signal 57 which is responsive to the difference between signals 51 and 56. Signal 57 is scaled so as to be representative of the position of the control valve 58, which is operably located in conduit means 27, required to maintain the actual flow rate of air through conduit means 27 substantially equal to the desired flow rate represented by signal 51. Signal 57 is provided from the flow controller 52 as a control signal for the control valve 58 and the control valve 58 is manipulated in response thereto.

Signal 61 is representative of the flow rate of fuel through conduit means 21 required to supply sufficient heat to the boiler 11 to enable the boiler 11 to supply the steam required from boiler 11 to the common header 14.

Signal 61 is supplied as the set point input to the flow controller 62.

Flow transducer 64 in combination with the flow sensor 65, which is operably located in conduit means 21, provides an output signal 66 which is representative of the actual flow rate of fuel through conduit means 21. Signal 66 is supplied as the process variable input to the flow controller 62.

In response to signals 61 and 66, flow controller 62 provides an output signal 67 which is responsive to the difference between signals 61 and 66. Signal 67 is scaled so as to be representative of the position of the control valve 68, which is operably located in conduit means 21, required to maintain the actual flow rate of fuel through conduit means 21 substantially equal to the desired flow rate represented by signal 61. Signal 67 is provided from the flow controller 62 as the control signal for control valve 68 and control valve 68 is manipulated in response thereto.

Signal 71 is representative of the flow rate of air through conduit means 24 required for complete combustion of the fuel flowing through conduit means 21. Again, it is noted that in some cases it may be desired to supply excess air. Signal 71 is provided as the set point input to the flow controller 72.

Flow sensor 75 in combination with the flow transducer 74, which is operably located in conduit means 24, provides an output signal 76 which is representative of the actual flow rate of air through conduit means 24. Signal 76 is supplied as from the flow tranducer 74 as the process variable input to the flow controller 72.

In response to signals 71 and 76, the flow controller 72 provides an output signal 77 which is responsive to the difference between signals 71 and 76. Signal 77 is scaled so as to be representative of the position of the control valve 78, which is operably located in conduit means 24, required to maintain the actual flow rate of air through conduit means 24 substantially equal to the desired flow rate represented by signal 71. Signal 77 is provided from the flow controller 72 as a control signal for the control valve 78 and the control valve 78 is manipulated in response thereto.

Referring now to FIG. 2, signal 32 which is representative of the actual header pressure, is supplied as the process variable input to the pressure controller 111. The pressure controller 111 is also supplied with a set point signal 112 which is representative of the desired header pressure.

In response to signals 32 and 112, the pressure controller 111 provides an output signal 114 which is responsive to the difference between signals 32 and 112. Signal 114 is scaled so as to be representative of the total number of BTU's per hour which must be supplied to boilers 11 and 12 in order to maintain the actual header pressure substantially equal to the desired header pressure represented by signal 112. Signal 114 is provided from pressure controller 111 as a first input to the multiplying block 116 and also as a first input to the multiplying block 117.

The optimizer block 121 represents the conventional optimization method which is used in the present invention. As has been previously stated, a number of optimization methods are known. Some of the optimization methods which can be used with the present invention are described in the following references:

(1) "Optimization Techniques with Fortran", Kuester & Mize, 1973, McGraw-Hill.

(2) American Institute of Chemical Engineers Short Course, "Computer Process Control", Notes, 1973.

(3) "On-Line Optimization Techniques in Industrial Control", Advanced Control Conference, Purdue University, 1979. Optimization techniques other than those disclosed in the above references may be utilized if desired.

Conventional optimization methods require various process measurements. The process measurements required by each optimization method of the above references are disclosed in those references. Such measurements would be provided to computer 100 and utilized in the optimization method represented in the optimizer 121.

The optimizer 121 provides two output signals 122 and 123. Signal 122 is representative of the percentage of the total heat required per unit time, as representated by signal 114, which should be supplied to boiler 11 in order to substantially maximize the energy efficiency of boilers 11 and 12. In like manner, signal 123 is representative of the percentage of the total heat per unit time represented by signal 114 which should be supplied to boiler 12. Signal 122 is provided from the optimizer to the ramp block 124. Signal 123 is provided from the optimizer 121 to the ramp block 125.

The use of the ramp blocks 124 and 125 is desirable but is not required. The ramp blocks 124 and 125 are conventional and are utilized to prevent signals 122 or 123 from making a step change. Thus, if signal 122 is representative of 40% at a time $T_1$ and is then changed to 50% by the optimizer 121 at a time $T_2$, signal 127, which is provided as an output from the ramp block 124, would not immediately change to 50% but would slowly change to 50% over a period of time. This prevents a step change in the percentage value represented by signal 122 from causing a process disruption.

In like manner, ramp 125 is utilized to prevent a step change in signal 123 from causing a process disruption by causing signal 128 to slowly assume the new value of signal 123.

Signal 127 is provided from the ramp 124 as a second input to the multiplying block 116. In like manner, signal 128 is provided from the ramp block 125 as a second input to the multiplying block 117.

Signal 114 is multiplied by signal 127 in the multiplying block 116 to establish signal 129 which is representative of the number of BTU's per unit time which should be supplied to the boiler 11. Signal 129 is supplied from the multiplying block 116 as a first input to the multiplying block 131.

The multiplying block 131 is also supplied with signal 133 which is representative of the number of cubic feet (assuming a gaseous fuel) which must be combusted to supply one BTU. Generally, the value of signal 133 will be known for the fuel flowing through conduit means 25. However, if this value is not known or changes periodically, the value may be determined by conventional analysis.

Signal 129 is multiplied by signal 133 to establish signal 41 which is representative of the desired flow rate of fuel to the burner 26 associated with the boiler 12. Signal 41 is provided as a process control signal output from computer 100 and is utilized as previously described. Also, signal 41 is supplied as a first input to the multiplying block 135.

The multiplying block 135 is also supplied with signal 137 which is representative of the number of cubic feet of air which must be supplied for complete combustion of a cubic foot of the fuel flowing through conduit means 27. Again, the value for signal 137 will generally be known for any particular fuel. Also, it is noted that, if excess air is desired, the ratio represented by signal 137 can be increased to provide the desired percentage of excess air.

Signal 41 is multiplied by signal 137 to establish signal 51 which is representative of the desired flow rate of air through conduit means 27. Signal 51 is provided as a process control signal output from computer 100 and is utilized as previously described.

Signal 114 is multiplied by signal 128 in the multiplying block 117 to establish signal 139 which is representative of the number of BTU's per unit time which should be supplied to the boiler 11. Signal 139 is supplied from the multiplying block 117 as a first input to the multiplying block 141.

The multiplying block 141 is also supplied with signal 143 which is representative of the number of cubic feet (assuming a gaseous fuel) which must be combusted to supply one BTU. Generally, the value of signal 143 will be known for the fuel flowing through conduit means 21 and signal 143 would be the same as signal 133 if the two fuels are the same. However, if this value is not known or changes periodically, the value may be determined by conventional analysis.

Signal 139 is multiplied by signal 143 to establish signal 61 which is representative of the desired flow rate of fuel to the burner 22 associated with the boiler 11. Signal 61 is provided as a process control signal output from computer 100 and is utilized as previously described. Also, signal 61 is supplied as a first input to the multiplying block 145.

The multiplying block 145 is also supplied with signal 147 which is representative of the number of cubic feet of air which must be supplied for complete combustion of a cubic foot of the fuel flowing through conduit means 21. Again, the value for signal 147 will generally be known for any particular fuel and will again be the same signal 137 if the two fuels are the same. The ratio represented by signal 147 can be increased to provide any excess air desired.

Signal 61 is multiplied by signal 147 to establish signal 71 which is representative of the desired flow rate of air through conduit means 24. Signal 71 is provided as a process control signal output from computer 100 and is utilized as previously described.

In summary, a comparison of actual header pressure to desired header pressure is utilized to determine the total heat per unit time which must be supplied to the parallel boilers 11 and 12. Optimization is then utilized to determine what percentage of the total heat should be supplied to each of the boilers 11 and 12 to substantially maximize the energy efficiency of boilers 11 and 12 while still maintaining the desired header pressure. Control of the desired header pressure with optimization is accomplished on-line without significant operator intervention which is extremely desirable in many processes which are highly automated.

The invention has been described in terms of a preferred embodiment as illustrated in FIGS. 1 and 2. Control components illustrated in FIG. 1 such as pressure transducer 31; flow transducers 44, 54, 64 and 74; flow controllers 52, 62, 72 and 42; and control valves 48, 58, 68 and 78 are each well-known, commercially available components such as are illustrated and described in Perry's Chemical Engineers Handbook, 4th Edition, Chapter 22, McGraw-Hill.

For reasons of brevity, conventional auxiliary equipment such as feed lines and pumps and also additional control equipment which would normally be associated with the boilers 11 and 12 have not been included in the above description as they play no part in the explanation of the invention.

While the invention has been described in terms of the presently preferred embodiment, reasonable variations and modifications are possible by those skilled in the art. Such variations and modifications are within the scope of the described invention as claimed.

That which is claimed is:

1. Apparatus comprising:

a first boiler having a first burner associated therewith;

means for supplying a first fuel stream to said first burner;

means for supplying a first air stream to said first burner, wherein the combustion of said first fuel stream with said first air stream at said first burner supplies heat to said first boiler;

a header conduit;

means for supplying steam from said first boiler to said header conduit;

a second boiler having a second burner associated therewith;

means for supplying a second fuel stream to said second burner;

means for supplying a second air stream to said second burner, wherein the combustion of said second fuel stream with said second air stream at said second burner supplies heat to said second boiler;

means for supplying steam from said second boiler to said header conduit;

means for establishing a first signal representative of the pressure in said header conduit;

means for establishing a second signal representative of the desired pressure in said header conduit;

means for comparing said first signal and said second signal and for establishing a third signal which is responsive to the difference between said first signal and said second signal, wherein said third signal is scaled so as to be representative of the total heat per unit time which must be supplied to said first boiler and said second boiler by the combustion of said first fuel stream and said second fuel stream in order to maintain the actual pressure in said header conduit substantially equal to the desired pressure represented by said second signal;

means for establishing a fourth signal representative of the percentage of the total heat per unit time represented by said third signal which would be supplied to said first boiler in order to substantially optimize the energy efficiency of said first boiler and said second boiler;

means for multiplying said third signal by said fourth signal to establish a fifth signal representative of the heat per unit time which must be supplied to said first boiler by the combustion of said first fuel stream;

means for manipulating the flow of said first fuel stream and said first air stream to said first burner in response to said fifth signal;

means for establishing a sixth signal representative of the percentage of the total heat per unit time represented by said third signal which must be supplied to said second boiler in order to substantially maximize the energy efficiency of said first and second boilers;

means for multiplying said third signal by said sixth signal to establish a seventh signal which is representative of the total heat per unit time which must be supplied to said second boiler by the combustion of said second fuel stream; and means for manipulating the flow of said second fuel stream and said second air stream to said second burner in response to said seventh signal.

2. Apparatus in accordance with claim 1 wherein said means for manipulating the flow of said first fuel stream and said first air stream to said first burner in response to said fifth signal and said means for manipulating the flow of said second fuel stream and said second air stream to said second burner in response to said seventh signal comprises:

a first control valve operably located so as to control the flow of said first fuel stream;

a second control valve operably located so as to control the flow of said first air stream;

a third control valve operably located so as to control the flow of said second fuel stream;

a fourth control valve operably located so as to control the flow of said second air stream;

means for establishing an eighth signal representative of the amount of said fuel flowing in said first fuel stream which must be combusted in order to supply one BTU, wherein the fuel in said second fuel stream is the same as the fuel in said first fuel stream;

means for multiplying said fifth signal by said eighth signal to establish a ninth signal representative of the flow rate of said first fuel stream required to supply the heat per unit time represented by said fifth signal;

means for establishing a tenth signal representative of the actual flow rate of the said first fuel stream;

means for comparing said ninth signal and said tenth signal and for establishing an eleventh signal which is responsive to the difference between said ninth signal and said tenth signal, wherein said eleventh signal is scaled so as to be representative of the position of said first control valve required to maintain the actual flow rate of said first fuel stream substantially equal to the desired flow rate represented by said ninth signal;

means for manipulating said first control valve in response to said eleventh signal;

means for establishing a twelfth signal representative of a desired air to fuel ratio;

means for multiplying said ninth signal by said twelfth signal to establish a thirteenth signal which is representative of the desired flow rate of said first air stream;

means for establishing a fourteenth signal representative of the actual flow rate of said first air stream;

means for comparing said thirteenth signal and said fourteenth signal and for establishing a fifteenth signal which is responsive to the difference between said thirteenth signal and said fourteenth signal, wherein said fifteenth signal is scaled so as to be representative of the position of said second control valve required to maintain the actual flow rate of said first air stream substantially equal to the desired flow rate represented by said thirteenth signal;

means for manipulating said second control valve in response to said fifteenth signal;

means for multiplying said seventh signal by said eighth signal to establish a sixteenth signal which is representative of the flow rate of said second fuel stream required to supply the required heat to said second boiler;

means for establishing a seventeenth signal representative of the actual flow rate of said second fuel stream;

means for comparing said sixteenth signal and said seventeenth signal and for establishing an eighteenth signal which is responsive to the difference between said sixteenth signal and said seventeenth signal, wherein said eighteenth signal is scaled so as to be representative of the position of said third control valve required to maintain the actual flow rate of said second fuel stream substantially equal to the desired flow rate represented by said sixteenth signal;

means for manipulating said third control valve in response to said eighteenth signal;

means for multiplying said twelfth signal by said sixteenth signal to establish a nineteenth signal representative of the desired flow rate of said second air stream;

means for establishing a twentieth signal representative of the actual flow rate of said second air stream;

means for comparing said nineteenth signal and said twentieth signal and for establishing a twenty first signal which is responsive to the difference between said nineteenth signal and said twentieth signal, wherein said twenty first signal is scaled so as to be representative of the position of said fourth control valve required to maintain the actual flow rate of said second air stream substantially equal to the desired flow rate represented by said nineteenth signal; and means for manipulating said fourth control valve in response to said twenty first signal.

3. A method for manipulating the flow of a first fuel stream and a first air stream to a first burner associated with a first boiler and for manipulating the flow of a second fuel stream and a second air stream to a second burner associated with a second boiler, wherein the combustion of said first fuel stream with said first air stream at said first burner supplies heat to said first boiler, wherein the combustion of said second fuel stream with said second air stream at said second burner supplies heat to said second boiler, and wherein steam is supplied from said first boiler and from said second boiler to a header conduit, said method comprising the steps of:

establishing a first signal representative of the pressure in said header conduit;

establishing a second signal representative of the desired pressure in said header conduit;

comparing said first signal and said second signal and establishing a third signal which is responsive to the difference between said first signal and said second signal, wherein said third signal is scaled so as to be representative of the total heat per unit time which must be supplied to said first boiler and said second boiler by the combustion of said first fuel stream and said second fuel stream in order to maintain the actual pressure in said header conduit substantially equal to the desired pressure represented by said second signal;

establishing a fourth signal representative of the percentage of the total heat per unit time represented by said third signal which should be supplied to said first boiler in order to substantially optimize the energy efficiency of said first boiler and said second boiler;

multiplying said third signal by said fourth signal to establish a fifth signal representative of the heat per unit time which must be supplied to said first boiler by the combustion of said first fuel stream;

manipulating the flow of said first fuel stream and said first air stream to said first burner in response to said fifth signal;

establishing a sixth signal representative of the percentage of the total heat per unit time represented by said third signal which must be supplied to said second boiler in order to substantially maximize the energy efficiency of said first and second boilers;

multiplying said third signal by said sixth signal to establish a seventh signal which is representative of the total heat per unit time which must be supplied to said second boiler by the combustion of said second fuel stream; and manipulating the flow of said second fuel stream and said second air stream to said second burner in response to said seventh signal.

4. A method in accordance with claim 3 wherein said step of manipulating the flow of said first fuel stream and said first air stream to said first burner in response to said fifth signal and said step of manipulating the flow of said second fuel stream and said second air stream to said second burner in response to said seventh signal comprises:

establishing an eighth signal representative of the amount of said fuel flowing in said first fuel stream which must be combusted in order to supply one BTU, wherein the fuel in said second fuel stream is the same as the fuel in said first fuel stream;

multiplying said fifth signal by said eighth signal to establish a ninth signal representative of the flow rate of said first fuel stream required to supply the heat per unit time represented by said fifth signal;

establishing a tenth signal representative of the actual flow rate of the said first fuel stream;

comparing said ninth signal and said tenth signal and establishing an eleventh signal which is responsive to the difference between said ninth signal and said tenth signal, wherein said eleventh signal is scaled so as to be representative of the position of a first control valve operably located so as to control the flow of said first fuel stream required to maintain the actual flow rate of said first fuel stream substantially equal to the desired flow rate represented by said ninth signal;

manipulating said first control valve in response to said eleventh signal;

establishing a twelfth signal representative of a desired air to fuel ratio;

multiplying said ninth signal by said twelfth signal to establish a thirteenth signal which is representative of the desired flow rate of said first air stream;

establishing a fourteenth signal representative of the actual flow rate of said first air stream;

comparing said thirteenth signal and said fourteenth signal and establishing a fifteenth signal which is responsive to the difference between said thirteenth signal and said fourteenth signal, wherein said fifteenth signal is scaled so as to be representative of the position of a second control valve operably located so as to control the flow of said first air stream required to maintain the actual flow rate of said first air stream substantially equal to the desired flow rate represented by said thirteenth signal;

manipulating said second control valve in response to said fifteenth signal;

multiplying said seventh signal by said eighth signal to establish a sixteenth signal which is representative of the flow rate of said second fuel stream required to supply the required heat to said second boiler;

establishing a seventeenth signal representative of the actual flow rate of said second fuel stream;

comparing said sixteenth signal and said seventeenth signal and establishing an eighteenth signal which is responsive to the difference between said sixteenth signal and said seventeenth signal, wherein said eighteenth signal is scaled so as to be representative of the position of a third control valve operably located so as to control the flow of said second fuel stream required to maintain the actual flow rate of said second fuel stream substantially equal to the desired flow rate represented by said sixteenth signal;

manipulating said third control valve in response to said eighteenth signal;

multiplying said twelfth signal by said sixteenth signal to establish a nineteenth signal representative of the desired flow rate of said second air stream;

establishing a twentieth signal representative of the actual flow rate of said second air stream;

comparing said nineteenth signal and said twentieth signal and establishing a twenty first signal which is responsive to the difference between said nineteenth signal and said twentieth signal, wherein said twenty first signal is scaled so as to be representative of the position of a fourth control valve operably located so as to control the flow of said second air stream to maintain the actual flow rate of said second air stream substantially equal to the desired flow rate represented by said nineteenth signal; and manipulating said fourth control valve in response to said twenty first signal.

* * * * *